US010446109B2

(12) United States Patent
Shiibayashi

(10) Patent No.: US 10,446,109 B2
(45) Date of Patent: Oct. 15, 2019

(54) DISPLAY DRIVER CONVERTING PIXEL DATA PIECES INTO GRADATION VOLTAGES AND SEMICONDUCTOR APPARATUS INCLUDING DISPLAY DRIVER

(71) Applicant: LAPIS Semiconductor Co., Ltd., Yokohama (JP)

(72) Inventor: Kenichi Shiibayashi, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 58 days.

(21) Appl. No.: 15/690,566

(22) Filed: Aug. 30, 2017

(65) Prior Publication Data

US 2018/0061359 A1 Mar. 1, 2018

(30) Foreign Application Priority Data

Aug. 31, 2016 (JP) ..... 2016-170231

(51) Int. Cl.
*G09G 3/36* (2006.01)

(52) U.S. Cl.
CPC ..... *G09G 3/3696* (2013.01); *G09G 3/3648* (2013.01); *G09G 3/3688* (2013.01); *G09G 2310/027* (2013.01); *G09G 2310/0289* (2013.01); *G09G 2310/0291* (2013.01); *G09G 2310/0297* (2013.01); *G09G 2310/08* (2013.01); *G09G 2320/0233* (2013.01)

(58) Field of Classification Search
CPC .. G09G 3/3688; G09G 3/3648; G09G 3/3696; G09G 2310/027; G09G 2310/0233; G09G 2310/0291; G09G 2310/0297; G09G 2310/08; G09G 2310/0289
See application file for complete search history.

(56) References Cited

U.S. PATENT DOCUMENTS 6,535,189 B1 * 3/2003 Akiyama ..... G09G 3/2011 345/100
2011/0090198 A1 * 4/2011 Hsueh ..... G09G 3/3688 345/211
2011/0310080 A1 * 12/2011 Tonomura ..... G09G 3/3688 345/211

FOREIGN PATENT DOCUMENTS

JP 2001-034234 A 2/2001

* cited by examiner

*Primary Examiner* — Kwang-Su Yang
(74) *Attorney, Agent, or Firm* — Rabin & Berdo, P.C.

(57) ABSTRACT

A display driver includes: a plurality of decoders that converts a plurality of pixel data pieces representing luminance levels for pixels into gradation voltages having magnitudes corresponding to the luminance levels represented by the pixel data pieces, respectively; a plurality of amplifiers that provides a plurality of driving voltages obtained by amplifying the gradation voltages to a plurality of data lines of a display device, respectively; and a reference gradation voltage generator that generates a plurality of reference gradation voltages having respective different voltage values corresponding to gradation levels. Each of the decoders includes a short-circuiting control circuit that controls whether to short-circuit between a first line and a second line of each of the decoders.

11 Claims, 11 Drawing Sheets

CONVENTIONAL ART

DISPLAY DRIVER CONVERTING PIXEL DATA PIECES INTO GRADATION VOLTAGES AND SEMICONDUCTOR APPARATUS INCLUDING DISPLAY DRIVER

CROSS-REFERENCES TO RELATED APPLICATIONS

This application is based upon and claims the benefit of priority from the prior Japanese Patent Application No. 2016-170231 filed on Aug. 31, 2016, the entire contents of which are incorporated herein by reference.

BACKGROUND OF THE INVENTION

1. Field of the Invention

The present invention relates to a display driver for driving a display device on the basis of a video signal, and a semiconductor apparatus including such a display driver.

2. Description of the Related Art

A liquid crystal display apparatus for displaying an image on the basis of a video signal, for example, includes a liquid crystal display panel as a display device, and a driver for driving a plurality of source lines in the display panel. The driver includes: a plurality of decoders for converting a plurality of gradation data pieces for pixels that are based on the video signal into analog gradation voltages, respectively; and a plurality of output amplifiers for amplifying the gradation voltages and providing the amplified gradation voltages to the source lines.

An output amplifier circuit 8 illustrated in FIG. 4 in Japanese Patent Application Laid-Open Publication No. 2001-34234 (hereinafter, referred to as Literature 1) receives two-line outputs (Vin1) and (Vin2) outputted from a decoder 7 at inputs (Vp1) and (Vp2), respectively, and generates a single output (Vout). When the inputs (Vp1) and (Vp2) have the same gradation voltage (e.g., V2), for example, the output (Vout) becomes V2. When the inputs (Vp1) and (Vp2) are gradation voltages adjacent to each other (e.g., V0 and V2), the output (Vout) becomes a voltage V1 equal to an intermediate value of the sum of the above two voltages.

As shown in FIG. 7 in Literature 1, the decoder 7 comprises: a decoder part that selects gradation voltages A, B, and C corresponding to three gradation levels from among 129 gradation levels inputted by the upper six bits in display data; and a multiplexer that selects one or two gradation voltages from among the gradation voltages A, B, and C by the lower two bits in the display data and outputs the selected gradation voltage(s) as outputs (Vin1) and (Vin2).

SUMMARY OF THE INVENTION

In the multiplexer shown in FIG. 7 in Literature 1, when the gradation voltage A and the gradation voltage B are outputted as the outputs (Vin1) and (Vin2), respectively, for example, an NMOS transistor to which the gradation voltage A is provided and an NMOS transistor to which the gradation voltage B is provided are set to an ON state according to Table 1 in Literature 1. Consequently, the gradation voltage A outputted from the NMOS transistor being supplied with the gradation voltage A is provided to the input (Vp1) of the output amplifier circuit 8 as the output (Vin1) via a line connecting between the multiplexer and the output amplifier circuit 8 (referred to as a first line). The gradation voltage B outputted from the NMOS transistor being supplied with the gradation voltage B is provided to the input (Vp2) of the output amplifier circuit 8 as the output (Vin2) via a line connecting between the multiplexer and the output amplifier circuit 8 (referred to as a second line). The voltage outputted from the one NMOS transistor being supplied with the gradation voltage A in the multiplexer reaches the input (Vp1) of the output amplifier circuit after the passage of a delay time dependent on a time constant due to parasitic capacitance in the first line and wiring resistance. The voltage outputted from the one NMOS transistor being supplied with the gradation voltage B in the multiplexer reaches the input (Vp2) of the output amplifier circuit after the passage of a delay time dependent on a time constant due to parasitic capacitance in the second line and wiring resistance.

When the same gradation voltages, e.g., the gradation voltages A are outputted as the outputs (Vin1) and (Vin2) in the multiplexer, only the NMOS transistor being supplied with the gradation voltage A is set to an ON state. Consequently, the gradation voltage A outputted from the NMOS transistor being supplied with the gradation voltage A is provided to the input (Vp1) of the output amplifier circuit 8 via the first line as the output (Vin1) and to the input (Vp2) of the output amplifier circuit 8 via the second line as the output (Vin2). The voltage outputted from the one NMOS transistor being supplied with the gradation voltage A in the multiplexer reaches the inputs (Vp1) and (Vp2) of the output amplifier circuit after the passage of a delay time corresponding to a time constant due to combined capacitance of the parasitic capacitance in the first line and the parasitic capacitance in the second line and the wiring resistance.

In other words, when a voltage outputted from one NMOS transistor in the multiplexer is provided to the two inputs (Vp1 and Vp2) of the output amplifier circuit, the wiring capacitance is increased and the delay time is prolonged accordingly as compared to a case where a voltage outputted from one NMOS transistor is provided to one input (Vp1 or Vp2) of the output amplifier circuit.

Therefore, when a supply cycle of gradation data pieces corresponding to pixels, i.e., one horizontal scanning period (hereinafter, referred to as a 1H period), is shortened because of higher-definition display, a voltage outputted from an output amplifier may not reach its desired voltage value within the 1H period.

When gradation data d0 representing the minimum luminance transitions to gradation data dl representing the maximum luminance at a time t0 as shown in FIG. 1, for example, the decoder provides a voltage PV corresponding to the maximum luminance to the input (Vp1) of the output amplifier via the first line, and provides the voltage PV to the input (Vp2) of the output amplifier via the second line. Consequently, the voltages of the first and second lines gradually increase as indicated by a broken line in FIG. 1. Because of the influence of the delay corresponding to the time constant due to the combined capacitance of the parasitic capacitance in the first line and the parasitic capacitance in the second line as well as the wiring resistance of the first and second lines, the voltages of the first and second lines fail to reach the target voltage PV even after the passage of the 1H period from the time t0 as shown in FIG. 1. Therefore, an output voltage outputted from the output amplifier in accordance with the voltages of the first and second lines also fails to reach the voltage PV even after the passage of the 1H period from the time t0 as indicated by a thick solid line in FIG. 1. When the 1H period has elapsed, the output voltage outputted from the output amplifier has a voltage value lower than the target voltage PV by an amount corresponding to a voltage ER.

Thus, there is a risk of causing degradation in image quality such that an image is displayed with luminance different from the originally intended luminance.

It is an object of the present invention to provide a display driver and a semiconductor apparatus capable of achieving high-definition display without causing degradation in image quality.

One aspect of the present invention provides a display driver including: a plurality of decoders configured to convert a plurality of pixel data pieces representing luminance levels for pixels into gradation voltages having magnitudes corresponding to the luminance levels represented by the pixel data pieces, respectively; and a plurality of amplifiers configured to provide a plurality of driving voltages obtained by amplifying the gradation voltages to a plurality of data lines of a display device, respectively. The display driver includes a reference gradation voltage generator configured to generate a plurality of reference gradation voltages having respective different voltage values corresponding to gradation levels. Each of the decoders includes: a first line and a second line; a converting part configured to select a reference gradation voltage corresponding to a luminance level represented by the pixel data piece from among the plurality of reference gradation voltages and then provides the selected reference gradation voltage to the amplifier via the first line as the gradation voltage; a voltage supply part configured to provide one of the reference gradation voltages excluding the selected reference gradation voltage to the second line; and a short-circuiting control circuit configured to control whether to short-circuit between the first line and the second line or not.

Another aspect of the present invention provides a semiconductor apparatus having a display driver including: a plurality of decoders configured to convert a plurality of pixel data pieces representing luminance levels for pixels into gradation voltages having magnitudes corresponding to the luminance levels represented by the pixel data pieces, respectively; and a plurality of amplifiers configured to provide a plurality of driving voltages obtained by amplifying the gradation voltages to a plurality of data lines of a display device, respectively. The display driver includes a reference gradation voltage generator configured to generate a plurality of reference gradation voltages having respective different voltage values corresponding to gradation levels. Each of the decoders includes: a first line and a second line; a converting part configured to select a reference gradation voltage corresponding to a luminance level represented by the pixel data piece from among the plurality of reference gradation voltages and then provides the selected reference gradation voltage to the amplifier via the first line as the gradation voltage; a voltage supply part configured to provide one of the reference gradation voltages excluding the selected reference gradation voltage to the second line; and a short-circuiting control circuit configured to control whether to short-circuit between the first line and the second line or not.

The display driver of the present invention performs a process as described below when selecting a reference gradation voltage corresponding to a luminance level represented by the pixel data piece from among the plurality of reference gradation voltages generated in the reference gradation voltage generator and providing the selected reference gradation voltage to the amplifier via the first line as the gradation voltage. More specifically, the display driver controls whether the first line and the second line to which one of the plurality of reference gradation voltages excluding the reference gradation voltage selected as described above is provided are short-circuited. Consequently, a first current accompanied by the gradation voltage corresponding to the luminance level represented by the pixel data piece and a second current accompanied by the above one reference gradation voltage flow through the first line over a period during which a voltage value of the first line is increasing or decreasing. Therefore, an increase or decrease speed in the voltage value of the first line is accelerated as compared to a case where parasitic capacitance is charged only by the first current. Thus, the display driver of the present invention enables the voltage value of the display driving voltage outputted from the amplifier to reach, for every horizontal scanning period, the desired voltage value corresponding to the luminance gradation level represented by the pixel data within that period. Thus, display without degradation in image quality can be achieved even at the time of high-definition display having a short horizontal scanning period.

DETAILED DESCRIPTION OF THE INVENTION

An embodiment of the present invention will now be described below in detail with reference to the drawings.

Figure 1:
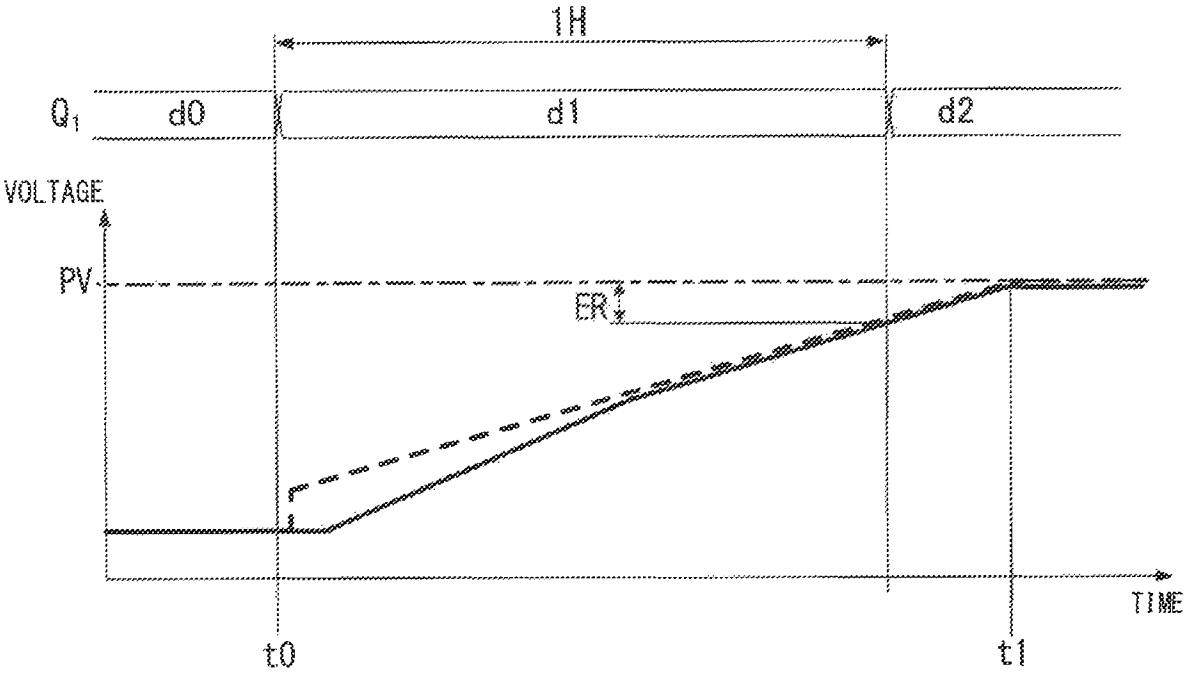
FIG. 1 is a chart illustrating an exemplary delay pattern of output voltage in an output amplifier of a conventional display driver.
Figure 2:
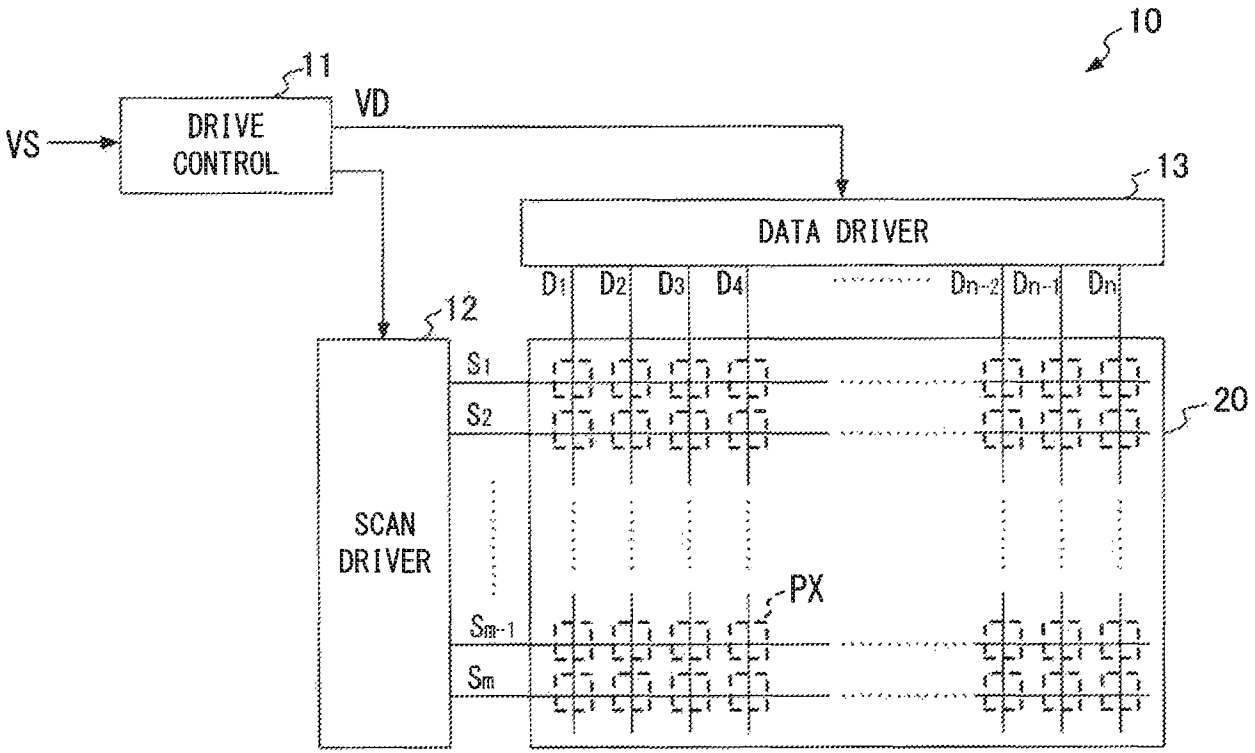
FIG. 2 is a block diagram illustrating a configuration of a display apparatus 10 including a display driver according to the present invention.

FIG. 2 is a block diagram illustrating a configuration of a display apparatus 10 including a display driver according to the present invention. As shown in FIG. 2, the display apparatus 10 includes a drive control part 11, a scan driver 12, a data driver 13, and a display device 20 comprising a liquid crystal or organic EL panel.

The display device 20 includes: m horizontal scanning lines $S_1$ to $S_m$ (m is a natural number greater than or equal to 2) each extending in a horizontal direction of a two-dimensional screen; and n data lines $D_1$ to $D_n$ (n is a natural number greater than or equal to 2) each extending in a vertical direction of the two-dimensional screen. A display cell PX, functioning as a pixel, is formed in each of intersection areas between the horizontal scanning lines and the data lines, i.e., an area surrounded by broken lines in FIG. 2.

For each pixel, the drive control part 11 generates a sequence of pixel data PD representing a luminance level of the pixel by 6-bit data, for example, on the basis of an inputted video signal VS. The drive control part 11 then provides a video data signal VD including the sequences of the pixel data PD to the data driver 13. The drive control part 11 detects a horizontal synchronizing signal from the inputted video signal VS, and provides the horizontal synchronizing signal to the scan driver 12.

The scan driver 12 generates a horizontal scanning pulse in synchronization with the horizontal synchronizing signal provided by the drive control part 11. The scan driver 12 applies the horizontal scanning pulse to the horizontal scanning lines $S_1$ to $S_n$ of the display device 20 sequentially and selectively.

Figure 3:
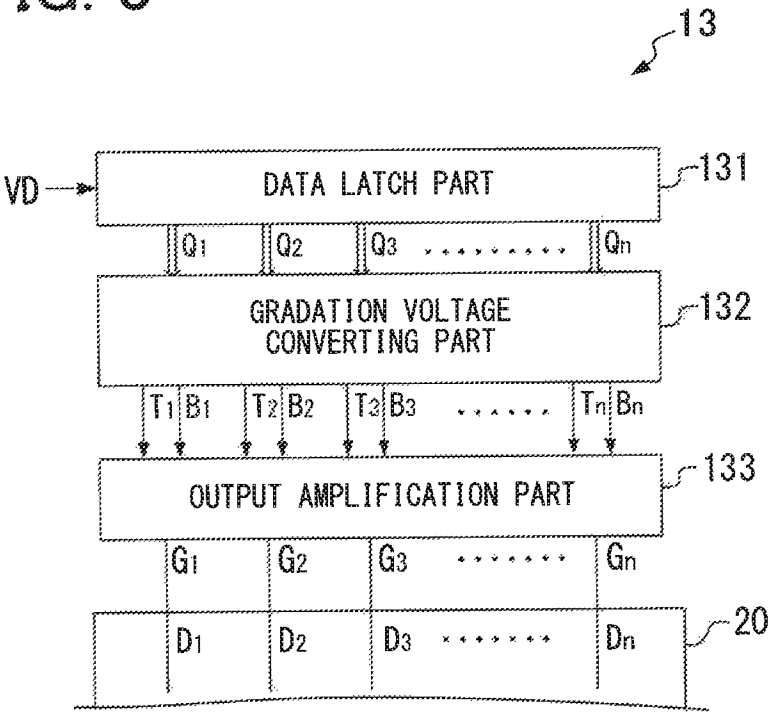
FIG. 3 is a block diagram illustrating an internal configuration of a data driver 13.

FIG. 3 is a block diagram illustrating an internal configuration of the data driver 13, which functions as a display driver. The data driver 13 is formed in a single semiconductor chip or formed over a plurality of semiconductor chips.

As shown in FIG. 3, the data driver 13 includes a data latch part 131, a gradation voltage converting part 132, and an output amplification part 133.

The data latch part 131 sequentially captures the sequences of the pixel data PD included in the video data signal VD provided by the drive control part 11. Every time the data latch part 131 captures the pixel data PD corresponding to one horizontal scanning line (i.e., n pieces of pixel data PD), the data latch part 131 provides the n pieces of pixel data PD to the gradation voltage converting part 132 as pixel data $Q_1$ to $Q_n$.

The gradation voltage converting part 132 converts the pixel data $Q_1$ to $Q_n$ provided by the data latch part 131 into gradation voltages $T_1$ to $T_n$ having voltage values corresponding to luminance levels represented by the pixel data Q and into gradation voltages $B_1$ to $B_n$ having voltage values reduced by one gradation level from the voltage values of the gradation voltages $T_1$ to $T_n$, respectively. The gradation voltage converting part 132 provides the gradation voltages $T_1$ to $T_n$ and $B_1$ to $B_n$ to the output amplification part 133.

Figure 4:
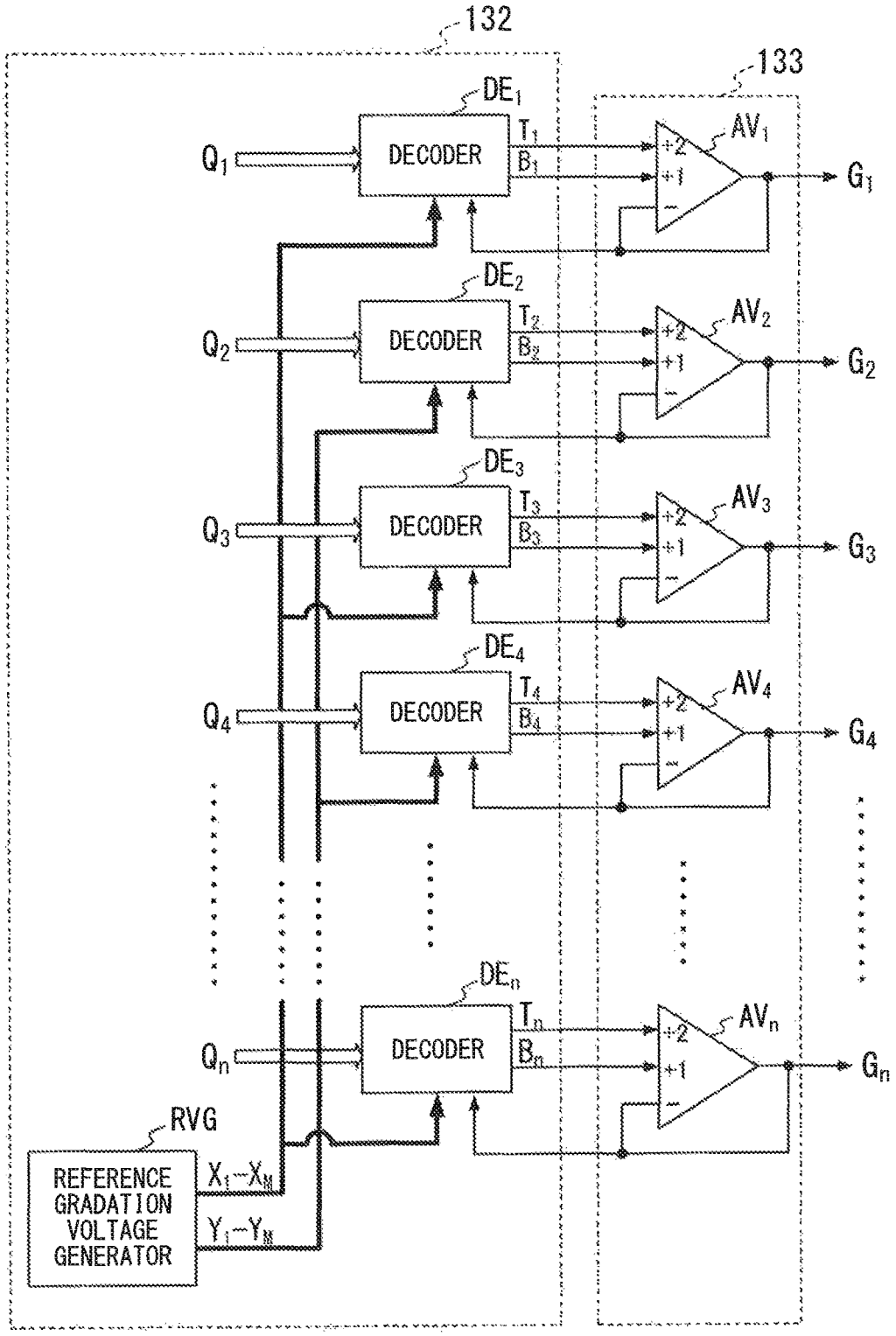
FIG. 4 is a block diagram illustrating internal configurations of a gradation voltage converting part 132 and an output amplification part 133.

FIG. 4 is a block diagram illustrating internal configurations of the gradation voltage converting part 132 and the output amplification part 133. As shown in FIG. 4, the gradation voltage converting part 132 includes a reference gradation voltage generator RVG and decoders $DE_1$ to $DE_n$. The output amplification part 133 includes amplifiers $AV_1$ to $AV_n$ each including a first non-inverting input terminal (+1), a second non-inverting input terminal (+2), and an inverting input terminal (−1).

The reference gradation voltage generator RVG generates positive reference gradation voltages $X_1$ to $X_M$ each corresponding to one of M gradation levels, which are obtained by dividing a range of luminance levels expressible by the display device 20 into M sections (M is an integer greater than or equal to 2), and each having a different voltage value. The reference gradation voltage generator RVG also generates negative reference gradation voltages $Y_1$ to $Y_M$ each corresponding to one of the M gradation levels, and each having a different voltage value. Unlike the reference gradation voltages ($X_1$ to $X_M$ and $Y_1$ to $Y_M$) corresponding to the M gradation levels and generated by the reference gradation voltage generator RVG, gradation levels expressible by the pixel data $Q_1$ to $Q_n$ are the first to (2M−1)-th gradation levels, which are obtained by dividing the range of luminance levels expressible by the display device 20 into (2M−1) sections.

The reference gradation voltage generator RVG provides the positive reference gradation voltages $X_1$ to $X_M$ to odd-number decoders DE of the decoders $DE_1$ to $DE_n$. The reference gradation voltage generator RVG also provides the negative reference gradation voltages $Y_1$ to $Y_M$ to even-number decoders DE of the decoders $DE_1$ to $DE_n$.

On the basis of the reference gradation voltages $X_1$ to $X_M$, the decoder $DE_1$ generates the gradation voltage $T_1$ having a voltage value corresponding to the luminance level represented by the pixel data $Q_1$, and provides the gradation voltage $T_1$ to the second non-inverting input terminal (+2) of the amplifier $AV_1$. The decoder $DE_1$ provides a gradation voltage having a voltage value lower than the gradation voltage $T_1$ by one gradation level or the gradation voltage $T_1$ itself to the first non-inverting input terminal (+1) of the amplifier $AV_1$ as the gradation voltage $B_1$.

Similarly, a decoder $DE_P$ (P is an integer of 2 to n) generates a gradation voltage $T_P$ having a voltage value corresponding to a luminance level represented by pixel data $Q_P$ provided to the decoder $DE_P$ based on the reference gradation voltages $X_1$ to $X_M$ ($Y_1$ to $Y_M$). The decoder $DE_P$ then provides the gradation voltage $T_P$ to the second non-inverting input terminal (+2) of an amplifier $AV_P$. The decoder $DE_P$ further provides a gradation voltage having a voltage value lower than the gradation voltage $T_P$ by one gradation level or the gradation voltage $T_P$ itself to the first non-inverting input terminal (+1) of the amplifier $AV_P$ as a gradation voltage $B_P$.

Each of the amplifiers $AV_1$ to $AV_n$ is what is called a voltage follower operational amplifier in which the output terminal and the inverting input terminal thereof are connected to each other.

The amplifier $AV_1$ adds the gradation voltage $B_1$ provided to the first non-inverting input terminal (+1) thereof and the gradation voltage $T_1$ provided to the second non-inverting input terminal (+2) thereof together. The amplifier $AV_1$ outputs a voltage that is obtained by amplifying a voltage of one half of the sum ($T_1$+$B_1$) at a gain of 1 as a display driving voltage $G_1$. The amplifier $AV_1$ provides the display driving voltage $G_1$ to the decoder $DE_1$.

Similarly, the amplifier $AV_P$ (P is an integer of 2 to n) adds the gradation voltage $B_P$ provided to the first non-inverting input terminal (+1) thereof and the gradation voltage $T_P$ provided to the second non-inverting input terminal (+2) thereof together. The amplifier $AV_P$ outputs a voltage that is obtained by amplifying a voltage of one half of the sum ($T_P$+$B_P$) at a gain of 1 as a display driving voltage $G_P$. The amplifier $AV_P$ provides the display driving voltage $G_P$ to the decoder $DE_P$.

The decoders $DE_1$ to $DE_n$ all have the same internal configuration.

The internal configuration of the decoders $DE_1$ to $DE_n$ will now be described in detail taking the decoder $DE_1$ as an example.

Figure 5:
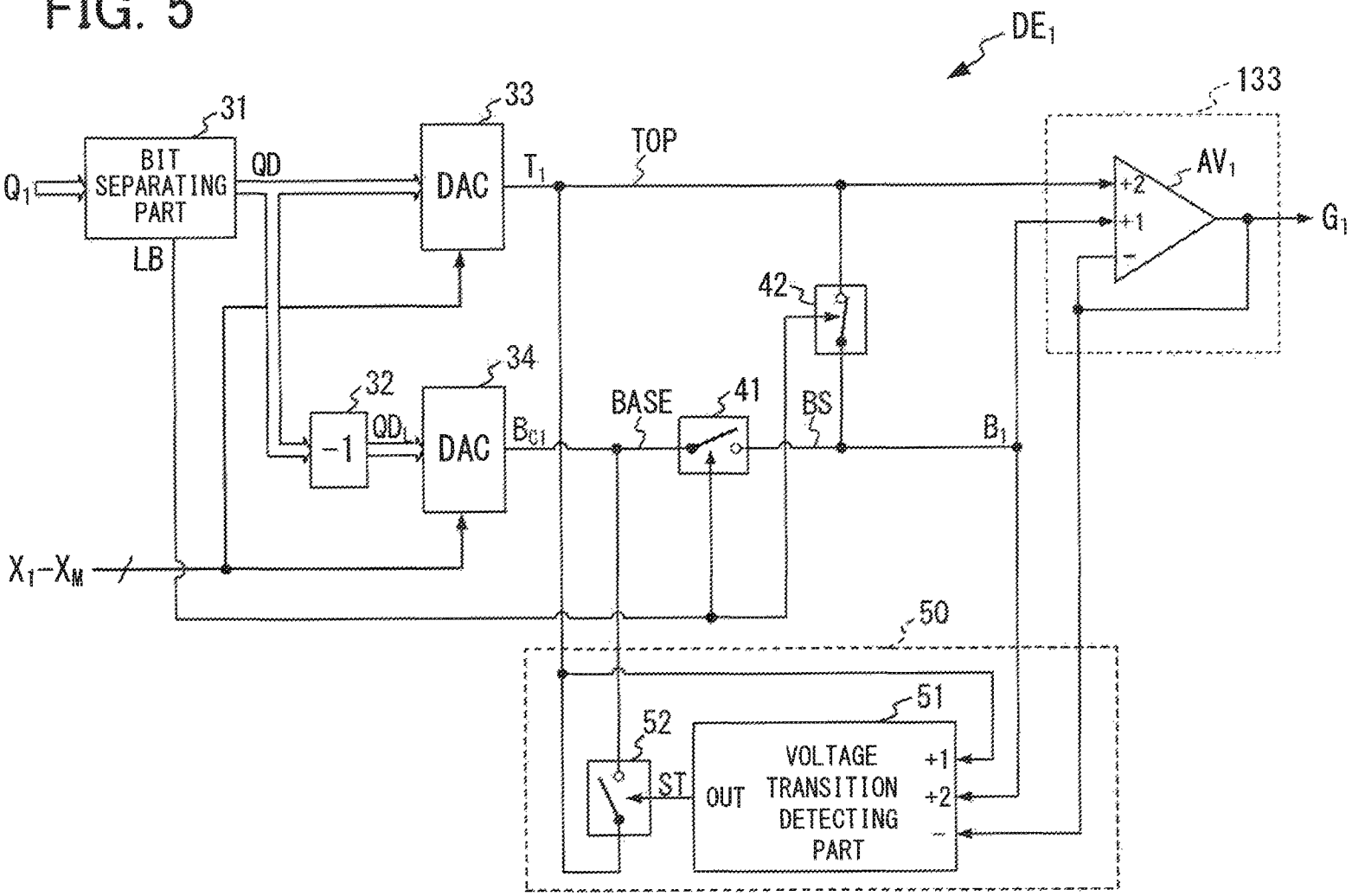
FIG. 5 is a circuit diagram illustrating an internal configuration of a decoder $DE_1$ and an amplifier $AV_1$.

FIG. 5 is a circuit diagram illustrating the internal configuration of the decoder $DE_1$ and the amplifier $AV_1$ connected to the decoder $DE_1$. As shown in FIG. 5, the decoder $DE_1$ includes a bit separating part 31, a one-gradation level subtractor 32, digital to analog converters (DACs) 33 and 34, switching elements 41 and 42, and a short-circuiting control circuit 50.

The bit separating part 31 separates a data bit group in the pixel data $Q_1$ into the least significant bit and an upper bit group excluding the least significant bit. The bit separating part 31 provides the separated upper bit group to the one-gradation level subtractor 32 and the DAC 33 as pixel data QD. The bit separating part 31 also provides a least significant bit signal LB representing the separated least significant bit to the switching elements 41 and 42.

The one-gradation level subtractor 32 subtracts 1 from the pixel data QD to generate pixel data $QD_L$ that is reduced by one gradation level from the pixel data QD. The one-gradation level subtractor 32 then provides the pixel data $QD_L$ to the DAC 34.

The DAC 33 selects a reference gradation voltage having a voltage value corresponding to a luminance level represented by the pixel data QD from among the reference gradation voltages $X_1$ to $X_M$. The DAC 33 provides, as the gradation voltage $T_1$, the selected reference gradation voltage to the switching element 42, the short-circuiting control circuit 50, and the second non-inverting input terminal (+2) of the amplifier $AV_1$ via a line TOP.

The DAC 34 selects a reference gradation voltage having a voltage value corresponding to a luminance level represented by the pixel data $QD_L$ from among the reference gradation voltages $X_1$ to $X_M$. The DAC 34 provides the selected reference gradation voltage to the switching element 41 via a line BASE as a gradation voltage $B_{C1}$.

The switching element 41 is turned ON when the least significant bit signal LB represents a logic level 1, for example. When the least significant bit signal LB represents a logic level 0, on the other hand, the switching element 41 is turned OFF. In the ON state, the switching element 41 connects the line BASE with a line BS to provide the voltage of the line BASE to the first non-inverting input terminal (+1) of the amplifier $AV_1$ via the line BS. In the OFF state, on the other hand, the switching element 41 blocks the connection between the line BASE and the line BS.

The switching element 42 is turned ON when the least significant bit signal LB represents the logic level 0, for example. When the least significant bit signal LB represents the logic level 1, on the other hand, the switching element 42 is turned OFF. In the ON state, the switching element 42 makes a short circuit between the line TOP and the line BS. In the OFF state, on the other hand, the switching element 42 eliminates the short circuit between the line TOP and the line BS.

As just described, the switching elements 41 and 42 are set to the ON or OFF state in a complementary manner in accordance with the least significant bit signal LB representing the least significant bit in the pixel data $Q_1$. Thus, when the least significant bit signal LB represents the logic level 0, the switching element 42 provides the gradation voltage $T_1$ provided by the DAC 33 to the short-circuiting control circuit 50 and the first non-inverting input terminal (+1) of the amplifier $AV_1$ as the gradation voltage $B_1$. When the least significant bit signal LB represents the logic level 1, on the other hand, the switching element 41 provides the gradation voltage $B_{c1}$ provided by the DAC 34 to the short-circuiting control circuit 50 and the first non-inverting input terminal (+1) of the amplifier $AV_1$ as the gradation voltage $B_1$. The short-circuiting control circuit 50 includes a voltage transition detecting part 51 and a switching element 52.

On the basis of the voltage ($T_1$) of the line TOP and the voltage ($B_1$) of the line BS as well as the display driving voltage $G_1$ outputted from the amplifier $AV_1$, the voltage transition detecting part 51 detects a voltage transition period from the start of an increase or a decrease in the voltage value of the lines TOP and BS to a point in time when the voltage value reaches the voltage value corresponding to the reference gradation voltage selected in the DAC 33, and a constant voltage period during which the voltage value is fixed. In other words, the voltage transition detecting part 51 detects a period during which a difference between the voltage value of the line TOP and the voltage value of the display driving voltage G is greater than or equal to a predetermined value as the voltage transition period. The voltage transition detecting part 51 detects a period during which the difference is smaller than the predetermined value as the constant voltage period. The voltage transition detecting part 51 then provides a voltage transition detection signal ST representing one of the voltage transition period and the constant voltage period to the switching element 52 as a detection result.

When the voltage transition detection signal ST represents the voltage transition period, the switching element 52 is turned ON to make a short circuit between the line TOP and the line BASE. When the voltage transition detection signal ST represents the constant voltage period, the switching element 52, serving as a short-circuiting switch, is turned OFF to eliminate the short circuit between the line TOP and the line BASE.

Figure 6:
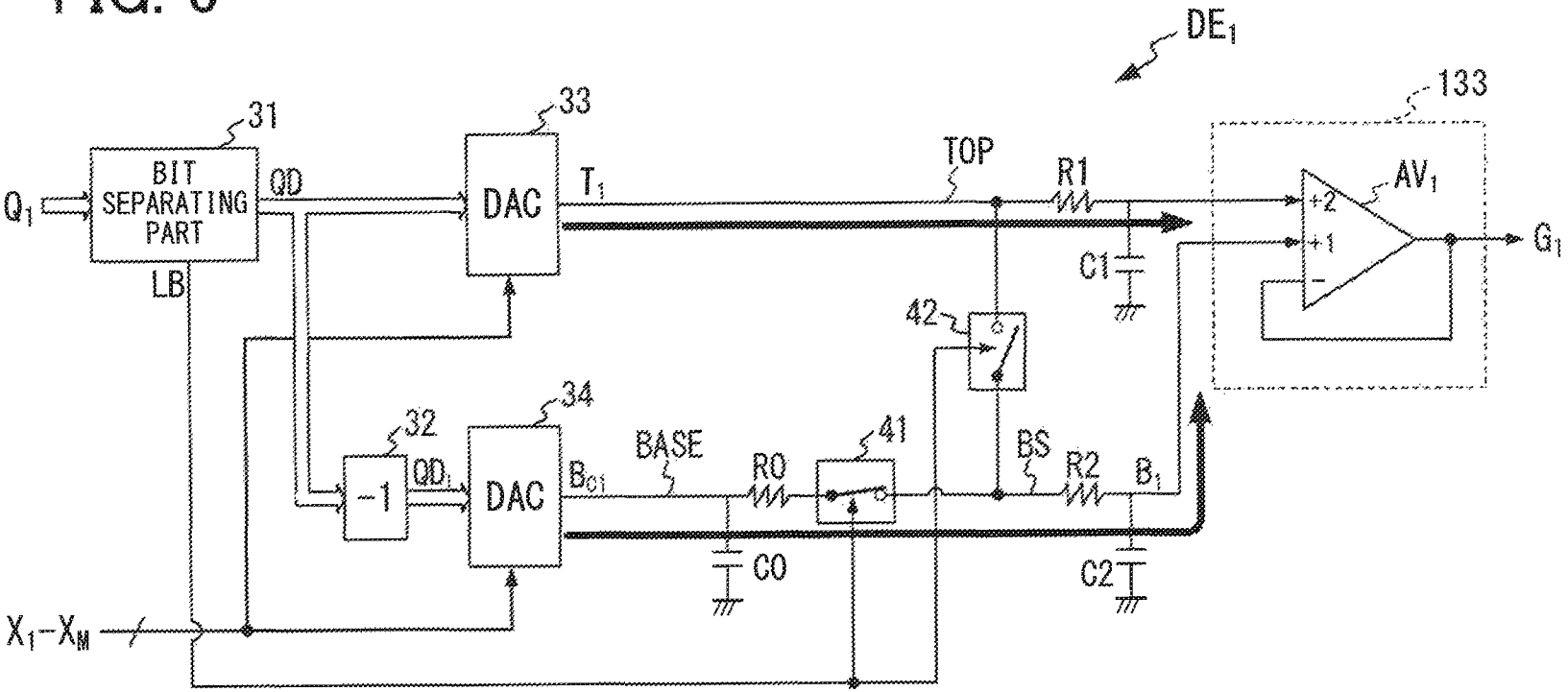
FIG. 6 is a circuit diagram showing an operation pattern in the decoder $DE_1$ when a luminance gradation level represented by pixel data $Q_1$ corresponds to an even-number gradation level.

When the luminance gradation level represented by the pixel data $Q_1$ corresponds to an even-number gradation level such as the second, fourth, or sixth gradation level, for example, the switching element 41 of the decoder DE' is set to the ON state and the switching element 42 is set to the OFF state as shown in FIG. 6. Consequently, the DAC 33 sends out a current having a magnitude corresponding to the gradation voltage $T_1$ to the line TOP as indicated by a thick arrow in FIG. 6. The DAC 34 sends out a current having a magnitude corresponding to the gradation voltage $B_{C1}$ to the line BASE, the switching element 41, and the line BS. The current flowed into the line TOP charges parasitic capacitance C1, and the voltage of the line TOP is gradually increased accordingly to reach the voltage value of the gradation voltage $T_1$. The current flowed into the line BS charges parasitic capacitance C2, and the voltage of the line BS is gradually increased accordingly to reach the voltage value of the gradation voltage $B_1$.

The amplifier $AV_1$ generates the display driving voltage $G_1$ having a voltage value intermediate between the gradation voltage $T_1$ and the gradation voltage $B_1$ having a voltage value lower than the gradation voltage $T_1$ by one gradation level.

As shown in FIG. 6, the line TOP has wiring delay (hereinafter, referred to as wiring delay $DT_{TOP}$) corresponding to a time constant due to the parasitic capacitance C1 and wiring resistance R1. The line BASE has wiring delay (hereinafter, referred to as wiring delay $DT_{BASE}$) corresponding to a time constant due to parasitic capacitance CO and wiring resistance R0. The line BS has wiring delay (hereinafter, referred to as wiring delay $DT_{BS}$) corresponding to a time constant due to the parasitic capacitance C2 and wiring resistance R2.

Therefore, when the DAC 33 provides the gradation voltage $T_1$ to the line TOP, the second non-inverting input terminal (+2) of the amplifier $AV_1$ reaches a voltage value equal to the gradation voltage $T_1$ after undergoing the wiring delay $DT_{TOP}$ by the line TOP. Similarly, when the DAC 34 provides the gradation voltage $B_{c1}$ to the line BASE, the first non-inverting input terminal (+1) of the amplifier $AV_1$ reaches a voltage value equal to the gradation voltage $B_{c1}$ after undergoing the wiring delay ($DT_{BASE}$+$DT_{BS}$) by the lines BASE and BS.

When the pixel data $Q_1$ transitions from the gradation level representing the lowest luminance to the gradation level representing the highest luminance among the even-number gradation levels, for example, a delay time taken for the amplifier $AV_1$ to output the display driving voltage $G_1$ corresponding to the gradation voltage $T_1$ from the transition point in time is shorter than a 1H period. When the switching element 41 is set to the ON state and the switching element 42 is set to the OFF state as shown in FIG. 6, the voltage value of the display driving voltage $G_1$ reaches, for every 1H period, the desired voltage value corresponding to the luminance gradation level represented by the pixel data $Q_1$ within the 1H period. Thus, display without degradation in image quality is achieved.

Figure 7:
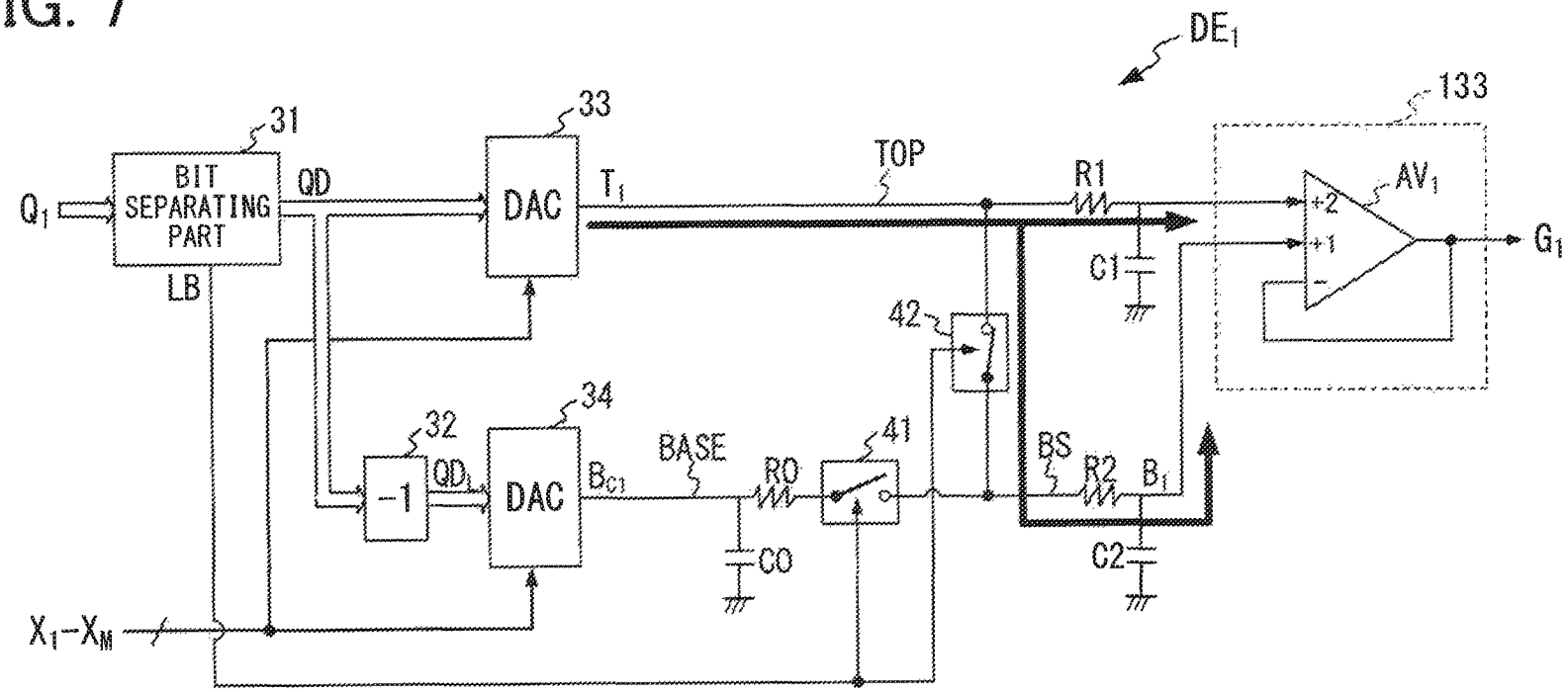
FIG. 7 is a circuit diagram showing an operation pattern in the decoder DE' when a luminance gradation level represented by pixel data $Q_1$ corresponds to an odd-number gradation level.

When the luminance gradation level represented by the pixel data $Q_1$ corresponds to an odd-number gradation level such as the first, third, or fifth gradation level, for example, the switching element 41 of the decoder $DE_1$ is set to the OFF state and the switching element 42 is set to the ON state as shown in FIG. 7. Consequently, the DAC 33 sends out a current having a magnitude corresponding to the gradation voltage $T_1$ to the line TOP and to the line BS via the switching element 42 as indicated by thick arrows in FIG. 7. The amplifier $AV_1$ generates a voltage value intermediate between the gradation voltage $T_1$ and the gradation voltage $B_1$ having the same voltage value as the gradation voltage $T_1$, i.e., a voltage having the voltage value equal to the gradation voltage $T_1$, as the display driving voltage $G_1$ corresponding to the luminance level represented by the pixel data $Q_1$.

When the switching element 41 is set to the OFF state and the switching element 42 is set to the ON state as shown in FIG. 7, the line TOP and the line BS are short-circuited. Thus, a current accompanied by the gradation voltage $T_1$ that is sent out from the DAC 33 flows through the line BS as well as the line TOP.

Here, parasitic capacitance in the lines TOP and BS through which the gradation voltage $T_1$ is provided corresponds to combined capacitance (C1+C2) of the parasitic capacitance C1 in the line TOP and the parasitic capacitance C2 in the line BS. Thus, as compared to the case, as shown in FIG. 6, where parasitic capacitance in the line through which the gradation voltage $T_1$ is provided corresponds to the parasitic capacitance C1 only, the parasitic capacitance is increased, thus increasing the wiring delay accordingly.

To reduce such wiring delay, each of the decoders $DE_1$ to $DE_n$ is provided with the short-circuiting control circuit 50.

Figure 8:
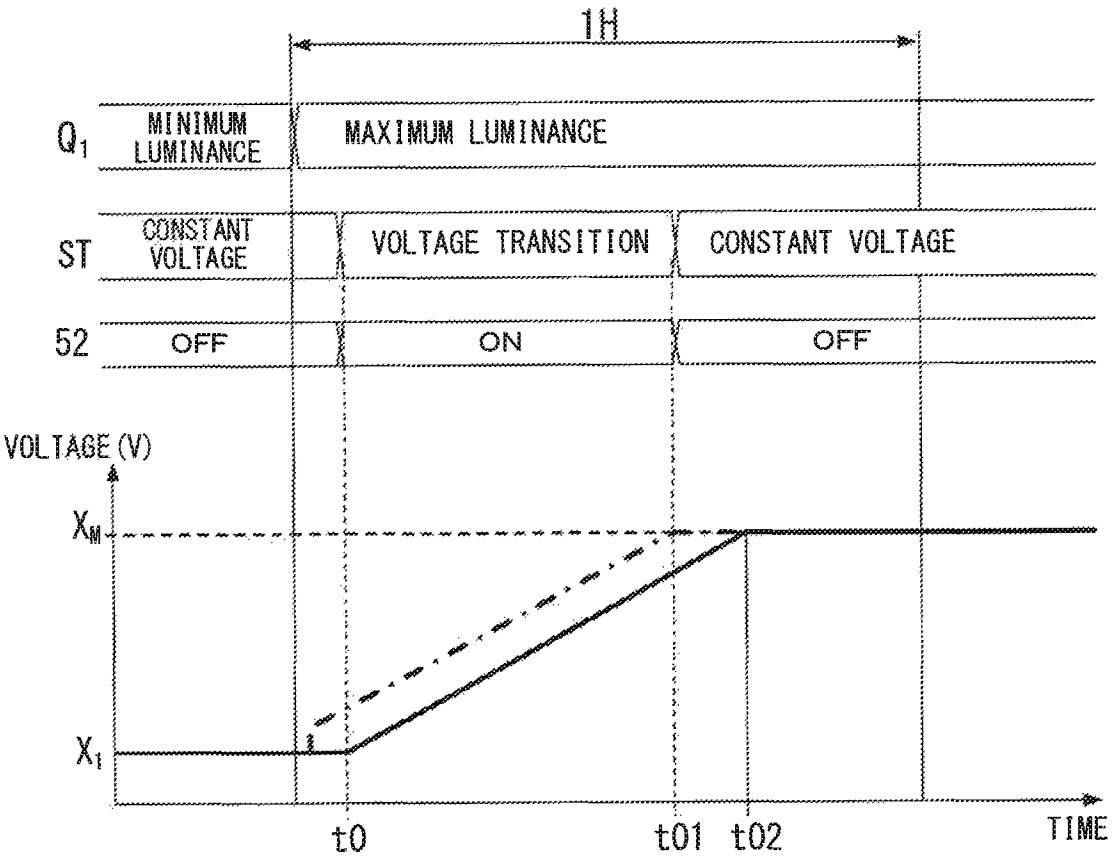
FIG. 8 is a waveform chart according to the present invention, showing exemplary voltage transition patterns in gradation voltages $T_1$ and $G_1$ when a luminance gradation level represented by pixel data $Q_1$ corresponds to an odd-number gradation level.

An operation of the short-circuiting control circuit 50 will now be described below with reference to FIG. 8. FIG. 8 is a waveform chart showing an operation of the short-circuiting control circuit 50 when the luminance gradation level represented by the pixel data $Q_1$ is changed from the gradation level corresponding to the minimum luminance to the gradation level corresponding to the maximum luminance.

First, the voltage value of the line TOP is kept at the state of the reference gradation voltage $X_1$ corresponding to the minimum luminance, for example. During this period, since no voltage transition occurs, the voltage transition detecting part 51 of the short-circuiting control circuit 50 provides the voltage transition detection signal ST representing the constant voltage period to the switching element 52 as shown in FIG. 8. This causes the switching element 52 to keep the OFF state. Thereafter, when the content of the pixel data $Q_1$ is changed from the gradation level representing the minimum luminance to the gradation level representing the maximum luminance, the DAC 33 selects the reference gradation voltage $X_M$ corresponding to the maximum luminance from among the reference gradation voltages $X_1$ to $X_M$. The DAC 33 then starts to provide the reference gradation voltage $X_M$ to the line TOP as the gradation voltage $T_1$. Since the switching element 41 is in the OFF state and the switching element 42 is in the ON state, a current having a magnitude corresponding to the gradation voltage $T_1$ flows into the lines TOP and BS as indicated by thick arrows in FIG. 9. Consequently, the parasitic capacitance C1 and C2 is charged. This causes the voltage value of the line TOP to increase gradually as indicated by an alternate long and short dashed line in FIG. 8.

Figure 9:
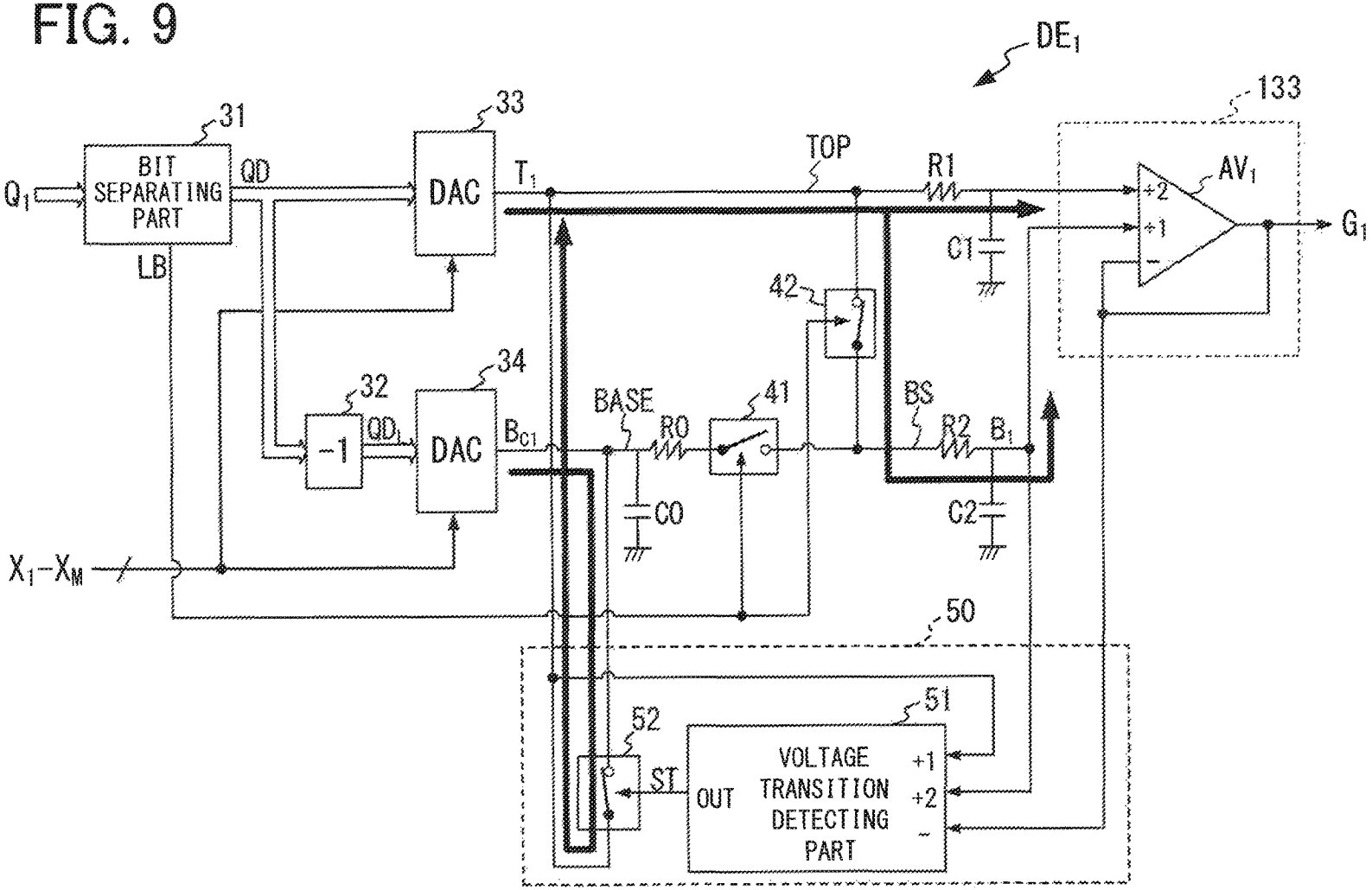
FIG. 9 is a circuit diagram according to the present invention, showing an operation pattern in the decoder $DE_1$ when a luminance gradation level represented by pixel data $Q_1$ corresponds to an odd-number gradation level.

Following the increase in the voltage value of the line TOP, the display driving voltage $G_1$ starts to increase at a time t0 as indicated by a thick solid line in FIG. 8. Over a period during which a difference between the voltage values of the line TOP and the display driving voltage $G_1$ is greater than or equal to the predetermined value, the voltage transition detecting part 51 provides the voltage transition detection signal ST representing the voltage transition period to the switching element 52. While the voltage transition detection signal ST represents the voltage transition period, the switching element 52 is in the ON state to make a short circuit between the lines TOP and BASE as shown in FIG. 9. In the ON state, the switching element 52 provides the gradation voltage $B_{C1}$ outputted from the DAC 34 to the line TOP.

Thus, a current accompanied by the gradation voltage $T_1$ that is sent out from the DAC 33 flows into the line TOP and a current accompanied by the gradation voltage $B_{C1}$ that is sent out from the DAC 34 flows into the line TOP via the line BASE and the switching element 52 as indicated by thick arrows in FIG. 9. Consequently, the parasitic capacitance C1 of the line TOP and the parasitic capacitance C2 of the line BS are charged by a combined current of the current sent out from the DAC 33 and the current sent out from the DAC 34. Then, the voltage value of the line TOP, i.e., the voltage value of the gradation voltage $T_1$ starts to increase from the state of the reference gradation voltage $X_1$ and the voltage value reaches the reference gradation voltage $X_M$ at a time t01 as indicated by the alternate long and short dashed line in FIG. 8. During this period, the amplifier $AV_1$ generates an output voltage having a voltage value equal to the gradation voltage $T_1$ changing as indicated by the alternate long and short dashed line in FIG. 8. The amplifier $AV_1$ then outputs the generated output voltage that is delayed by an amount equal to its element delay as the display driving voltage $G_1$ indicated by the thick solid line in FIG. 8. Thus, the display driving voltage $G_1$ started to increase at the time t0 reaches the reference gradation voltage $X_M$ at a time t02, which is later than the time t01, as indicated by the thick solid line in FIG. 8.

Thus, the operation of the short-circuiting control circuit 50 enables the voltage value of the line TOP to reach the desired voltage value ($X_M$) corresponding to the maximum luminance from the voltage value ($X_1$) corresponding to the minimum luminance faster than the case where the parasitic capacitance C1 and C2 is charged only by the current sent out from the DAC 33. This also enables the voltage value of the display driving voltage $G_1$ to reach, for every 1H period, the desired voltage value corresponding to the luminance gradation level represented by the pixel data $Q_1$ within the 1H period as shown in FIG. 8 when the gradation level represented by the pixel data $Q_1$ corresponds to an odd-number gradation level, for example, i.e., when the switching element 41 is set to the OFF state and the switching element 42 is set to the ON state.

Thus, the decoders $DE_1$ to $DE_n$ each including the short-circuiting control circuit 50 enable display without degradation in image quality even at the time of high-definition display having a short 1H period.

When the voltage value of the line TOP becomes constant, the voltage transition detecting part 51 provides the voltage transition detection signal ST representing the constant voltage period to the switching element 52 as shown in FIG. 8. This turns the switching element 52 OFF, and thus the short circuit between the lines TOP and BASE is eliminated. In other words, the switching element 52 stops providing the gradation voltage $B_{C1}$ to the line TOP in the OFF state. Therefore, no gradation voltage $B_{C1}$ outputted from the DAC 34 is superimposed on the display driving voltage $G_1$ after the voltage value of the line TOP reaches the voltage value corresponding to the pixel data $Q_1$. Thus, degradation in image quality is prevented from occurring.

In the short-circuiting control circuit 50, the lines TOP and BASE are short-circuited to send out the current sent out from the DAC 34 to the line TOP in addition to the current sent out from the DAC 33 while the voltage of the line TOP is increasing or decreasing, i.e., only when the luminance level represented by the pixel data Q is changed. Therefore, when no change occurs in the luminance level represented by the pixel data Q, no current sent out from the DAC 34 is sent out to the line TOP. This can prevent an increase in power consumption.

While a speed-up of a voltage increase speed in the rise period of the voltage value in the gradation voltage $T_1$ has been described in the above embodiment, the short-circuiting control circuit 50 similarly achieves a speed-up of a voltage decrease speed also in a fall period of the voltage value in the gradation voltage $T_1$. In the above embodiment, during the voltage transition period, a reference gradation voltage (X or Y) corresponding to a luminance level represented by pixel data Q is provided to the line TOP as a gradation voltage T and a reference gradation voltage having a voltage value lower than the above reference gradation voltage by one gradation level is provided to the line BASE as a gradation voltage $B_c$; and the lines TOP and BASE are short-circuited. As a voltage provided to the line BASE, a reference gradation voltage having a voltage value lower than a reference gradation voltage corresponding to a luminance level represented by pixel data Q by one gradation level is employed. This enables the voltage value of the line TOP to reach the voltage value corresponding to the luminance level represented by the pixel data Q quickly in the constant voltage period immediately after the voltage transition period.

The voltage provided to the line BASE in the voltage transition period does not necessarily need to be the reference gradation voltage lower than the reference gradation voltage corresponding to the luminance level represented by the pixel data Q by one gradation level. In other words, in the voltage transition period, one of the reference gradation voltages $X_1$ to $X_M$ or $Y_1$ to $Y_M$ generated by the reference gradation voltage generator RVG excluding the reference gradation voltage corresponding to the luminance level represented by the pixel data Q is provided to the line BASE. Furthermore, the lines TOP and BASE are short-circuited by the switching element 52.

In the above embodiment, the amplifier having two-line non-inverting input terminals (+1 and +2) is employed as each of the amplifiers $AV_1$ to $AV_n$. However, an amplifier having three-line or more non-inverting input terminals can be similarly employed as each of the amplifiers $AV_1$ to $AV_n$.

In sum, it is only necessary for each of the decoders $DE_1$ to $DE_n$ to include the following converting part, voltage supply part, and short-circuiting control circuit. More specifically, the converting part (33) selects a reference gradation voltage corresponding to a luminance level represented by a pixel data piece (Q) from among a plurality of reference gradation voltages ($X_1$ to $X_M$ or $Y_1$ to $Y_M$). The converting part (33) then provides the selected reference gradation voltage to an amplifier (AV) via a first line (TOP) as a gradation voltage (T). The voltage supply part (32 and 34) provides one of the plurality of reference gradation voltages excluding the reference gradation voltage selected as described above to a second line (BASE). The short-circuiting control circuit (50, 51, and 52) switches between control to make a short circuit between the first and second lines (the switching element 52 is turned ON) and control to eliminate such a short circuit (the switching element 52 is turned OFF).

With such a configuration, a first current accompanied by the gradation voltage corresponding to the luminance level represented by the pixel data piece and a second current accompanied by the above one reference gradation voltage flow through the first line. Therefore, parasitic capacitance in the first line is charged by a combined current of the first and second currents. Thus, an increase or decrease speed in the voltage value of the first line is accelerated as compared to a case where the parasitic capacitance is charged only by the first current. This enables a voltage value of a display driving voltage (G) outputted from the amplifier (AV) to reach, for every 1H period, the desired voltage value corresponding to the luminance gradation level represented by the pixel data (Q) within the 1H period.

Thus, display without degradation in image quality can be achieved even at the time of high-definition display having a short 1H period.

The first and second lines are short-circuited while the voltage of the first line is increasing or decreasing, i.e., only when the luminance level represented by the pixel data piece is changed. Thus, when no change occurs in the luminance level represented by the pixel data piece, no second current is provided to the first line. This can prevent an increase in power consumption.

In the above embodiment, the decoders $DE_1$ to $DE_n$ are each provided with the same short-circuiting control circuit 50 including the voltage transition detecting part 51 and the switching element 52. When an op-amp comparator is employed as the voltage transition detecting part 51, however, the internal configuration of the voltage transition detecting part 51 and the switching element 52 included in the short-circuiting control circuit 50 differs depending on the polarity of the reference gradation voltages provided to that decoder DE.

Figure 10:
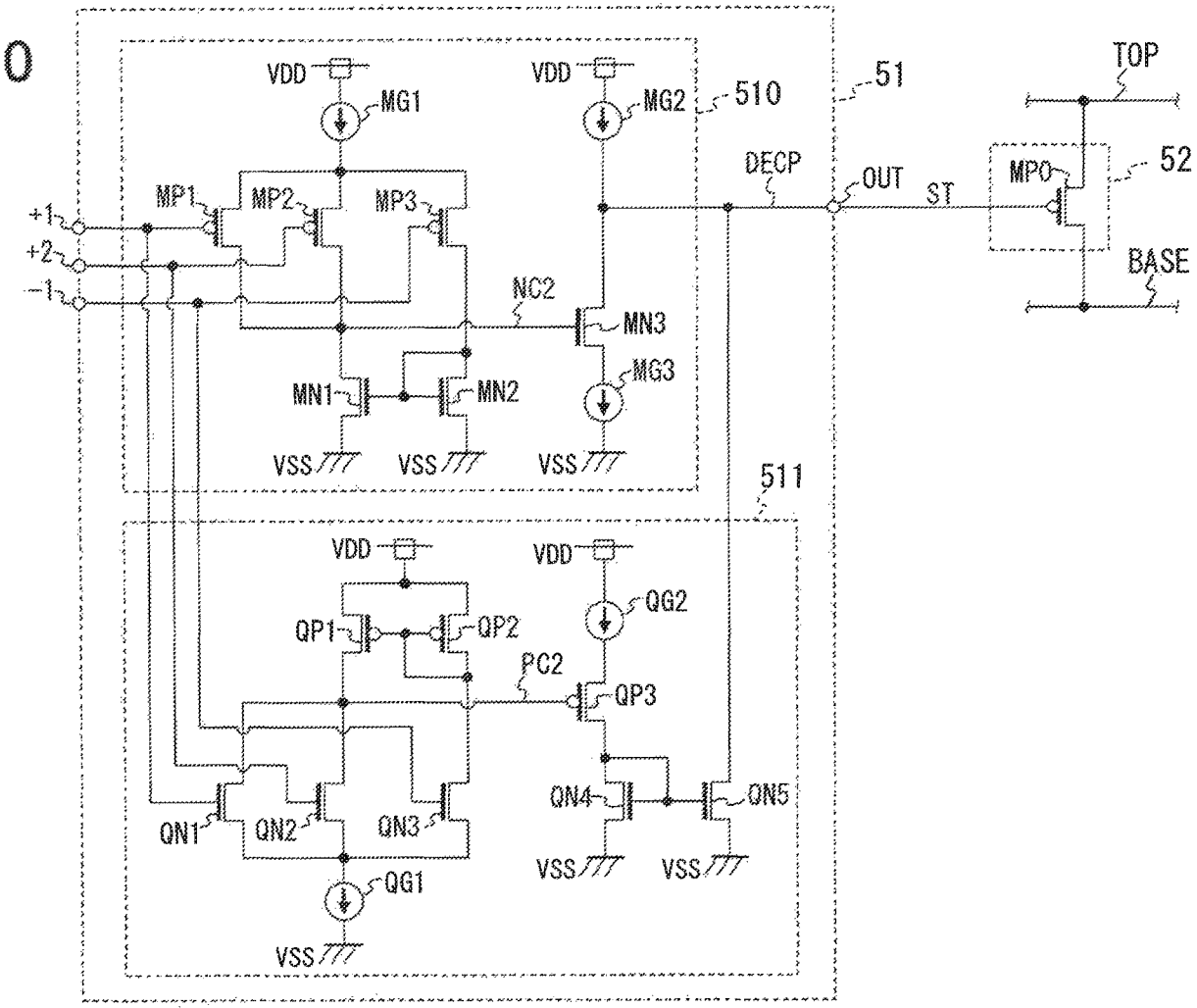
FIG. 10 is a circuit diagram illustrating an exemplary internal configuration of a short-circuiting control circuit 50 included in each decoder DE to which positive reference gradation voltages $X_1$ to $X_M$ are provided.

FIG. 10 is a circuit diagram illustrating an exemplary internal configuration of the short-circuiting control circuit 50 included in each decoder DE to which the positive reference gradation voltages $X_1$ to $X_M$ are provided. According to the configuration illustrated in FIG. 10, the voltage transition detecting part 51 includes a voltage fall detecting section 510 and a voltage rise detecting section 511 each comprising an op-amp comparator. The switching element 52 comprises a p-channel metal-oxide semiconductor (MOS) transistor MP0.

The voltage fall detecting section 510 includes p-channel MOS transistors MP1 to MP3, n-channel MOS transistors MN1 to MN3, and current sources MG1 to MG3. The current source MG1 receives the supply of a power-supply voltage VDD to generate a predetermined constant current. The current source MG1 then provides the predetermined constant current to source terminals of the transistors MP1 to MP3. A gate terminal of the transistor MP1 is connected to a first non-inverting input terminal (+1) that receives a gradation voltage T. A gate terminal of the transistor MP2 is connected to a second non-inverting input terminal (+2) that receives a gradation voltage B. A gate terminal of the transistor MP3 is connected to an inverting input terminal (−1) that receives a display driving voltage G. A drain terminal of each of the transistors MP1 and MP2 is connected to a drain terminal of the transistor MN1 and a gate terminal of the transistor MN3 via a line NC2. A drain terminal of the transistor MP3 is connected to a drain terminal and a gate terminal of the transistor MN2. Gate terminals of the transistors MN1 and MN2 are connected to each other. A reference potential VSS (e.g., a ground potential of 0 V) is applied to source terminals of the transistors MN1 and MN2.

The current source MG2 receives the supply of the power-supply voltage VDD to generate a predetermined constant current, and sends out the generated current to a line DECP. The line DECP is connected to an output terminal OUT that serves as an output terminal of the voltage transition detecting part 51. A source terminal of the transistor MN3 is connected to one end of the current source MG3. The reference potential VSS is applied to the other end of the current source MG3. The current source MG3 generates a current larger than the current generated in the current source MG2, preferably a constant current twice or more as large as the current generated in the current source MG2, when the transistor MN3 is in an ON state. The current source MG3 then sends out the generated current to a supply line (not shown) of the reference potential VSS.

To prevent oscillations in the voltage fall detecting section 510, a gate width ratio among the transistors MP1 to MP3 in a differential part is set to:

1:1:4, and a gate width ratio between the transistors MN1 and MN2 in a current mirror part is set to:

2:1.

This gives the voltage fall detecting section 510 hysteresis. Consequently, in a DC state in which the voltage values of the gradation voltages T and B and the display driving voltage G are all equal, the line DECP is fixed to the state of the power-supply voltage VDD. Thus, an oscillation operation in the voltage fall detecting section 510 is prevented from occurring.

As shown in FIG. 10, the voltage rise detecting part 511 includes p-channel MOS transistors QP1 to QP3, n-channel MOS transistors QN1 to QN5, and current sources QG1 and QG2.

Gate terminals of the transistors QP1 and QP2 are connected to each other. The power-supply voltage VDD is applied to each of source terminals of the transistors QP1 and QP2. A gate terminal of the transistor QN1 is connected to the first non-inverting input terminal (+1) that receives the gradation voltage T. A gate terminal of the transistor QN2 is connected to the second non-inverting input terminal (+2) that receives the gradation voltage B. A gate terminal of the transistor QN3 is connected to the inverting input terminal (−1) that receives the display driving voltage G. Drain terminals of the transistors QN1 and QN2 are connected to a drain terminal of the transistor QP1 and a gate terminal of the transistor QP3 via a line PC2. A drain terminal of the transistor QN3 is connected to a drain terminal and the gate terminal of the transistor QP2. Source terminals of the transistors QN1 to QN3 are all connected to one end of the current source QG1. The reference potential VSS is applied to the other end of the current source QG1. When at least one of the transistors QN1 to QN3 is turned ON, the current source QG1 sends out a predetermined constant current to a supply line (not shown) of the reference potential VSS.

The current source QG2 receives the supply of the power-supply voltage VDD to generate a predetermined constant current and provides the generated current to a source terminal of the transistor QP3. A drain terminal of the transistor QP3 is connected to a drain terminal and a gate terminal of the transistor QN4. The gate terminal of the transistor QN4 and a gate terminal of the transistor QN5 are connected to each other. The reference potential VSS is applied to a source terminal of each of the transistors QN4 and QN5. A drain terminal of the transistor QN5 is connected to the line DECP.

To prevent oscillations in the voltage rise detecting part 511, a gate width ratio among the transistors QN1 to QN3 in a differential part is set to:

1:1:4, and a gate width ratio between the transistors QP1 and QP2 in a current mirror part is set to:

2:1.

This gives the voltage rise detecting part 511 hysteresis. Consequently, in the DC state in which the voltage values of the gradation voltages T and B and the display driving voltage G are all equal, the line DECP is fixed to the state of the power-supply voltage VDD. Thus, an oscillation operation in the voltage rise detecting part 511 is prevented from occurring.

In FIG. 10, regarding the p-channel MOS transistor MP0 that serves as the switching element 52, a source terminal thereof is connected to the line TOP, a drain terminal thereof is connected to the line BASE, and a gate terminal thereof is connected to the output terminal OUT of the voltage transition detecting part 51.

Operations of the voltage fall detecting part 510 and the voltage rise detecting part 511 will now be described below.

The voltage fall detecting part 510 and the voltage rise detecting part 511 detect if the voltage values of the gradation voltages T and B received at the first non-inverting input terminal (+1) and the second non-inverting input terminal (+2) are increasing (voltage rise), decreasing (voltage fall), or constant by utilizing the operating delay of the amplifier AV itself. More specifically, when the voltage values of the gradation voltages T and B are constant, the voltage values of the gradation voltages T and B are equal to the voltage value of the display driving voltage G generated in the amplifier AV. When the voltage values of the gradation voltages T and B are increasing or decreasing, the states of such voltage values are reflected in the display driving voltage G only after a predetermined period due to the influence of the operating delay of the amplifier AV. Therefore, during this period, the voltage values of the gradation voltages T and B are different from the voltage value of the display driving voltage G.

In view of the above, operations in the constant voltage period prior to the time t0 and in the constant voltage period prior from the time t01 on will be described first. The gradation voltages T and B received at the first non-inverting input terminal (+1) and the second non-inverting input terminal (+2) are equal to the display driving voltage G received at the inverting input terminal (−1).

Therefore, in the voltage fall detecting part 510, the line NC2 is set to the reference potential VSS, and the transistor MN3 is fixed to the OFF state. In the voltage rise detecting part 511, the line PC2 is set to the power-supply voltage VDD, and the transistor QP3 is fixed to the OFF state. Consequently, the line DECP connected to the output terminal OUT of the voltage transition detecting part 51 is charged by the constant current sent out from the current source MG2 in the voltage fall detecting part 510 and fixed to the voltage value of the power-supply voltage VDD accordingly. Therefore, in the constant voltage period prior to the time t0 and in the constant voltage period from the time t01 on in FIG. 8, the voltage transition detecting part 51 provides the voltage transition detection signal ST having a logic level 1 representing the constant voltage period to the gate terminal of the transistor MP0 serving as the switching element 52. This turns the transistor MP0 OFF.

Operations in the voltage rise period (t0 to t01) shown in FIG. 8, for example, during which the voltage values of the gradation voltages T and B increase will be described next. The voltage values of the gradation voltages T and B gradually increase as indicated by the alternate long and short dashed line in FIG. 8. The amplifier AV outputs an intermediate voltage value between the gradation voltages T and B as the display driving voltage G after undergoing its operating delay. Therefore, while the voltage value of the display driving voltage G gradually increases as indicated by the thick solid line in FIG. 8, the voltage values of the gradation voltages T and B are always higher than the voltage value of the display driving voltage G in this voltage rise period (t0 to t01). This causes a current flow through the transistors QN1 and QN2 in the voltage rise detecting part 511, thereby reducing the voltage of the line PC2. Consequently, the transistor QP3 is turned ON, a current having a magnitude corresponding to the current sent out from the current source QG2 flows through the transistor QN5, and the voltage of the line DECP is thereby reduced to the reference potential VSS. Thus, in the voltage rise period from the time t0 to the time t01 shown in FIG. 8, the voltage transition detecting part 51 provides the voltage transition detection signal ST having a logic level 0 representing the voltage transition period to the gate terminal of the transistor MP0 serving as the switching element 52. This turns the transistor MP0 ON, and the lines TOP and BASE are thus short-circuited.

Operations in the voltage fall period during which the voltage values of the gradation voltages T and B decrease will be described next. The voltage values of the gradation voltages T and B gradually decrease, and the amplifier AV outputs an intermediate voltage value between the gradation voltages T and B as the display driving voltage G after undergoing its operating delay. Therefore, while the voltage value of the display driving voltage G gradually decreases, the voltage values of the gradation voltages T and B are always lower than the voltage value of the display driving voltage G in this voltage fall period. This causes a current flow through the transistors MP1 and MP2 in the voltage fall detecting part 510, thereby increasing the voltage of the line NC2. Consequently, the transistor MN3 is turned ON, and the voltage of the line DECP is thereby reduced to the reference potential VSS. Thus, the voltage transition detecting part 51 provides the voltage transition detection signal ST having the logic level 0 representing the voltage transition period to the gate terminal of the transistor MP0 serving as the switching element 52. This turns the transistor MP0 ON, and the lines TOP and BASE are thus short-circuited.

Figure 11:
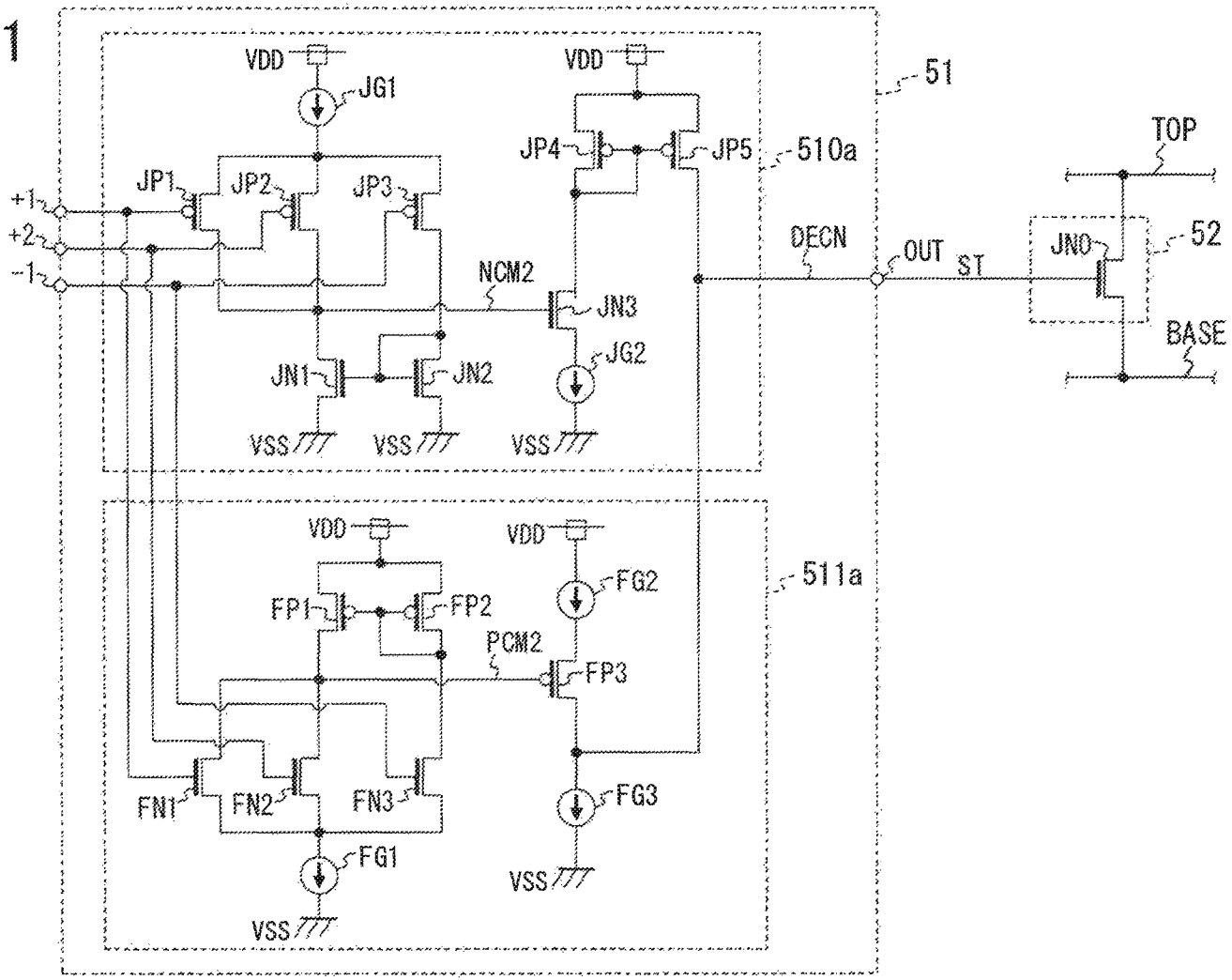
FIG. 11 is a circuit diagram illustrating an exemplary internal configuration of a short-circuiting control circuit 50 included in each decoder DE to which negative reference gradation voltages $Y_1$ to $Y_M$ are provided.

FIG. 11 is a circuit diagram illustrating an exemplary internal configuration of a short-circuiting control circuit 50 included in each decoder DE to which the negative reference gradation voltages $Y_1$ to $Y_M$ are provided. According to the configuration illustrated in FIG. 11, a voltage transition detecting part 51 includes a voltage fall detecting part 510*a* and a voltage rise detecting part 511*a* each comprising an op-amp comparator. A switching element 52 comprises an n-channel MOS transistor JN0.

The voltage fall detecting part 510*a* includes p-channel MOS transistors JP1 to JP5, n-channel MOS transistors JN1 to JN3, and current sources JG1 and JG2.

The current source JG1 receives the supply of a power-supply voltage VDD to generate a predetermined constant current. The current source JG1 then provides the generated current to source terminals of the transistors JP1 to JP3. A gate terminal of the transistor JP1 is connected to a first non-inverting input terminal (+1) that receives a gradation voltage $T_1$. A gate terminal of the transistor JP2 is connected to a second non-inverting input terminal (+2) that receives a gradation voltage $B_1$. A gate terminal of the transistor JP3 is connected to an inverting input terminal (−1) that receives a display driving voltage $G_1$. A drain terminal of each of the transistors JP1 and JP2 is connected to a drain terminal of the transistor JN1 and a gate terminal of the transistor JN3 via a line NCM2. A drain terminal of the transistor JP3 is connected to a drain terminal and a gate terminal of the transistor JN2. A gate terminal of the transistor JN1 and the gate terminal of the transistor JN2 are connected to each other. A reference potential VSS (e.g., a ground potential of 0 V) is applied to source terminals of the transistors JN1 and JN2.

A gate terminal and a drain terminal of the transistor JP4 are connected to each other. The gate terminal of the transistor JP4 and a gate terminal of the transistor JP5 are connected to each other. The power-supply voltage VDD is applied to source terminals of the transistors JP4 and JP5. A drain terminal of the transistor JN3 is connected to the drain terminal of the transistor JP4. A source terminal of the transistor JN3 is connected to one end of the current source JG2. The reference potential VSS is applied to the other end of the current source JG2. When the transistor JN3 is in the ON state, the current source JG2 sends out a predetermined constant current to a supply line (not shown) of the reference potential VSS. A drain terminal of the transistor JP5 is connected to a line DECN. The line DECN is connected to an output terminal OUT serving as an output terminal of the voltage transition detecting part 51.

To prevent oscillations in the voltage fall detecting part 510*a*, a gate width ratio among the transistors JP1 to JP3 in a differential part is set to:

1:1:4, and a gate width ratio between the transistors JN1 and JN2 in a current mirror part is set to:

2:1.

This gives the voltage fall detecting part 510*a* hysteresis. Consequently, in the DC state in which the voltage values of the gradation voltages T and B and the display driving voltage G are all equal, the line DECN is fixed to the state of the reference potential VSS. Thus, an oscillation operation in the voltage fall detecting part 510*a* is prevented from occurring.

As shown in FIG. 11, the voltage rise detecting part 511*a* includes p-channel MOS transistors FP1 to FP3, n-channel MOS transistors FN1 to FN3, and current sources FG1 to FG3.

Gate terminals of the transistors FP1 and FP2 are connected to each other. The power-supply voltage VDD is applied to each of source terminals of the transistors FP1 and FP2. A gate terminal of the transistor FN1 is connected to the first non-inverting input terminal (+1) that receives the gradation voltage $T_1$. A gate terminal of the transistor FN2 is connected to the second non-inverting input terminal (+2) that receives the gradation voltage $B_1$. A gate terminal of the transistor FN3 is connected to the inverting input terminal (−1) that receives the display driving voltage $G_1$. Drain terminals of the transistors FN1 and FN2 are connected to a drain terminal of the transistor FP1 and a gate terminal of the transistor FP3 via a line PCM2. A drain terminal of the transistor FN3 is connected to a drain terminal and the gate terminal of the transistor FP2. Source terminals of the transistors FN1 to FN3 are all connected to one end of the current source FG1. The reference potential VSS is applied to the other end of the current source FG1. When at least one of the transistors FN1 to FN3 is turned ON, the current source FG1 sends out a predetermined constant current to a supply line (not shown) of the reference potential VSS.

The current source FG2 receives the supply of the power-supply voltage VDD to generate a predetermined constant current and provides the generated current to a source terminal of the transistor FP3. A drain terminal of the transistor FP3 is connected to one end of the current source FG3 and the line DECN. The reference potential VSS is applied to the other end of the current source FG3. The current source FG3 generates a current smaller than the current generated in the current source FG2, preferably a constant current smaller than or equal to half the current generated in the current source FG2, and sends out the generated current to a supply line (not shown) of the reference potential VSS.

To prevent oscillations in the voltage rise detecting part 511*a*, a gate width ratio among the transistors FN1 to FN3 in a differential part is set to:

1:1:4, and a gate width ratio between the transistors FP1 and FP2 in a current mirror part is set to:

2:1.

This gives the voltage rise detecting part 511*a* hysteresis. Consequently, in the DC state in which the voltage values of the gradation voltages T and B and the display driving voltage G are all equal, the line DECN is fixed to the state of the reference potential VSS. Thus, an oscillation operation in the voltage rise detecting part 511*a* is prevented from occurring.

In FIG. 11, regarding the n-channel MOS transistor JN0 that serves as the switching element 52, a source terminal thereof is connected to the line TOP, a drain terminal thereof is connected to the line BASE, and a gate terminal thereof is connected to the output terminal OUT of the voltage transition detecting part 51.

Operations of the voltage fall detecting part 510*a* and the voltage rise detecting part 511*a* will now be described below.

The voltage fall detecting part 510*a* and the voltage rise detecting part 511*a* detect if the voltage values of the gradation voltages T and B received at the first non-inverting input terminal (+1) and the second non-inverting input terminal (+2) are increasing (voltage rise), decreasing (voltage fall), or constant by utilizing the operating delay of the amplifier AV itself. More specifically, when the voltage values of the gradation voltages T and B are constant, the voltage values of the gradation voltages T and B are equal to the voltage value of the display driving voltage G generated in the amplifier AV. When the voltage values of the gradation voltages T and B are increasing or decreasing, on the other hand, the states of such voltage values are reflected in the display driving voltage G only after a predetermined period due to the influence of the operating delay of the amplifier AV. Therefore, during this period, the voltage values of the gradation voltages T and B are different from the voltage value of the display driving voltage G.

In view of the above, operations in the constant voltage period prior to the time t0 and in the constant voltage period from the time t01 on in FIG. 8 will be described first. The gradation voltages T and B received at the first non-inverting input terminal (+1) and the second non-inverting input terminal (+2) are equal to the display driving voltage G received at the inverting input terminal (−1).

Therefore, in the voltage fall detecting part 510*a*, the line NCM2 is set to the reference potential VSS, and the transistor JN3 is fixed to the OFF state. In the voltage rise detecting part 511*a*, the line PCM2 is set to the power-supply voltage VDD, and the transistor FP3 is fixed to the OFF state. Consequently, the line DECN connected to the output terminal OUT of the voltage transition detecting part 51 is discharged by the current flowing through the current source FG3 in the voltage rise detecting part 511*a* and thereby fixed to the reference potential VSS. Therefore, in the constant voltage period prior to the time t0 and in the constant voltage period from the time t01 on in FIG. 8, the voltage transition detecting part 51 provides the voltage transition detection signal ST having a logic level 0 representing the constant voltage period to the gate terminal of the transistor JN0 serving as the switching element 52. This turns the transistor JN0 OFF.

Operations in the voltage rise period (t0 to t01) shown in FIG. 8, for example, during which the voltage values of the gradation voltages T and B increase will be described next. The voltage values of the gradation voltages T and B gradually increase as indicated by the alternate long and short dashed line in FIG. 8. The amplifier AV outputs an intermediate voltage value between the gradation voltages T and B as the display driving voltage G after undergoing its operating delay. Therefore, while the voltage value of the display driving voltage G gradually increases as indicated by the solid line in FIG. 8, the voltage values of the gradation voltages T and B are always higher than the voltage value of the display driving voltage G in this voltage rise period (t0 to t01). This causes a current flow through the transistors FN1 and FN2 in the voltage rise detecting part 511*a*, thereby reducing the voltage of the line PCM2. Consequently, the transistor FP3 is turned ON, the current sent out from the current source FG2 thus flows through the line DECN to charge the line DECN, and the line DECN reaches the voltage value of the power-supply voltage VDD. Thus, in the voltage rise period from the time t0 to the time t01 shown in FIG. 8, the voltage transition detecting part 51 provides the voltage transition detection signal ST having a logic level 1 representing the voltage transition period to the gate terminal of the transistor JN0 serving as the switching element 52. This turns the transistor JN0 ON, and the lines TOP and BASE are thus short-circuited.

Operations in the voltage fall period during which the voltage values of the gradation voltages T and B decrease will be described next. The voltage values of the gradation voltages T and B gradually decrease, and the amplifier AV outputs an intermediate voltage value between the gradation voltages T and B as the display driving voltage G after undergoing its operating delay. Therefore, while the voltage value of the display driving voltage G gradually decreases, the voltage values of the gradation voltages T and B are always lower than the voltage value of the display driving voltage G in this voltage fall period. This causes a current flow through the transistors JP1 and JP2 in the voltage fall detecting part 510*a*, thereby increasing the voltage of the line NCM2. Consequently, the transistor JN3 is turned ON, and a current having a magnitude corresponding to the current sent out from the current source JG2 flows through the transistor JP5 to charge the line DECN. Consequently, the voltage of the line DECN is increased to reach the power-supply voltage VDD. Thus, the voltage transition detecting part 51 provides the voltage transition detection signal ST having the logic level 1 representing the voltage transition period to the gate terminal of the transistor JN0 serving as the switching element 52. This turns the transistor JN0 ON, and the lines TOP and BASE are thus short-circuited.

While the reference potential VSS is set to a ground potential of 0 V, for example, in the configuration illustrated in FIG. 10 or 11, the voltage of the reference potential VSS is not limited to 0 V. For example, the reference potential VSS may be a potential higher than 0 V, e.g., a potential half the power-supply voltage VDD. As a result, lower power consumption can be achieved and the breakdown voltage of each transistor can be lowered. Thus, a reduction in the circuit size can be achieved.

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims.

What is claimed is:

1. A display driver comprising:

a plurality of decoders configured to convert a plurality of pixel data pieces representing luminance levels for pixels into gradation voltages having magnitudes corresponding to the luminance levels represented by the pixel data pieces, respectively;

a plurality of amplifiers configured to provide a plurality of driving voltages obtained by amplifying said gradation voltages to a plurality of data lines of a display device, respectively; and a reference gradation voltage generator configured to generate a plurality of reference gradation voltages having respective different voltage values corresponding to gradation levels, each of said decoders comprising:

a first line and a second line;

a converting part configured to select a reference gradation voltage corresponding to a luminance level represented by the pixel data piece from among said plurality of reference gradation voltages and then provides the selected reference gradation voltage to the amplifier via said first line as the gradation voltage;

a voltage supply part configured to provide one of the reference gradation voltages excluding the selected reference gradation voltage to said second line; and a short-circuiting control circuit configured to control whether to short-circuit between said first line and said second line or not, wherein said short-circuiting control circuit makes a short circuit between said first line and said second line over a voltage transition period from a start of an increase or a decrease in voltage of said first line to a point in time when the voltage of said first line reaches a voltage value corresponding to the selected reference gradation voltage, and said short-circuiting control circuit eliminates the short circuit between said first line and said second line in a constant voltage period during which voltage of said first line is constant.

2. The display driver according to claim 1, wherein the voltage transition period is a period of supplying the pixel data pieces in one horizontal scanning period.

3. The display driver according to claim 2, wherein said short-circuiting control circuit comprises:

a voltage transition detecting part configured to detect said voltage transition period and said constant voltage period; and a short-circuiting switch that is turned on to make a short circuit between said first line and said second line in said voltage transition period and turned off to eliminate the short circuit between said first line and said second line in said constant voltage period.

4. The display driver according to claim 3, wherein said voltage transition detecting part detects a period during which a difference between voltage values of said first line and the driving voltage is greater than or equal to a predetermined value as said voltage transition period and detects a period during which the difference is smaller than the predetermined value as said constant voltage period.

5. The display driver according to claim 1, wherein said voltage supply part provides, from among said plurality of reference gradation voltages, a reference gradation voltage having a voltage value lower than the reference gradation voltage corresponding to the luminance level represented by the pixel data piece by one gradation level to said second line as said one of the reference gradation voltages.

6. The display driver according to claim 5, wherein said short-circuiting control circuit comprises:

a voltage transition detecting part configured to detect said voltage transition period and a constant voltage period during which voltage of said first line is constant; and a short-circuiting switch that is turned on to make a short circuit between said first line and said second line in said voltage transition period and turned off to eliminate the short circuit between said first line and said second line in said constant voltage period.

7. The display driver according to claim 6, wherein said voltage transition detecting part detects a period during which a difference between voltage values of said first line and the driving voltage is greater than or equal to a predetermined value as said voltage transition period and detects a period during which the difference is smaller than the predetermined value as said constant voltage period.

8. The display driver according to claim 5, wherein said reference gradation voltage generator generates first to M-th (M is an integer greater than or equal to 2) reference gradation voltages having respective different voltage values as said plurality of reference gradation voltages, the pixel data piece represents the luminance level in one of first to (2M−1)-th gradation levels that are obtained by dividing a range of luminance levels expressible by the display device into (2M−1) sections, each of said decoders comprises:

a third line;

a first switching element that is turned on to connect said second line with said third line when said one of first to (2M−1)-th gradation levels represented by the pixel data piece is one of an odd-number gradation level and an even-number gradation level; and a second switching element that is turned on to make a short circuit between said first line and said third line when said one of first to (2M−1)-th gradation levels represented by the pixel data piece is the other one of the odd-number gradation level and the even-number gradation level, and each of said amplifiers outputs a voltage having a voltage value intermediate between voltage values of said first line and said third line as the driving voltage.

9. The display driver according to claim 1, wherein said short-circuiting control circuit comprises:

a voltage transition detecting part configured to detect said voltage transition period and said constant voltage period; and a short-circuiting switch that is turned on to make a short circuit between said first line and said second line in said voltage transition period and turned off to eliminate the short circuit between said first line and said second line in said constant voltage period.

10. The display driver according to claim 9, wherein said voltage transition detecting part detects a period during which a difference between voltage values of said first line and the driving voltage is greater than or equal to a predetermined value as said voltage transition period and detects a period during which the difference is smaller than the predetermined value as said constant voltage period.

11. A semiconductor apparatus comprising a display driver, the display driver comprising a plurality of decoders configured to convert a plurality of pixel data pieces representing luminance levels for pixels into gradation voltages having magnitudes corresponding to the luminance levels represented by the pixel data pieces, respectively, a plurality of amplifiers configured to provide a plurality of driving voltages obtained by amplifying the gradation voltages to a plurality of data lines of a display device, respectively, and a reference gradation voltage generator configured to generate a plurality of reference gradation voltages having respective different voltage values corresponding to gradation levels, each of said decoders comprising:

a first line and a second line;

a converting part configured to select a reference gradation voltage corresponding to a luminance level represented by the pixel data piece from among said plurality of reference gradation voltages and then provides the selected reference gradation voltage to the amplifier via said first line as the gradation voltage;

a voltage supply part configured to provide one of the reference gradation voltages excluding the selected reference gradation voltage to said second line; and a short-circuiting control circuit configured to control whether to short-circuit between said first line and said second line or not, wherein said short-circuiting control circuit makes a short circuit between said first line and said second line over a voltage transition period from a start of an increase or a decrease in voltage of said first line to a point in time when the voltage of said first line reaches a voltage value corresponding to the selected reference gradation voltage, and said short-circuiting control circuit eliminates the short circuit between said first line and said second line in a constant voltage period during which voltage of said first line is constant.

* * * * *